US006489983B2

(12) United States Patent
Miyoshi et al.

(10) Patent No.: US 6,489,983 B2
(45) Date of Patent: Dec. 3, 2002

(54) IMAGE RECORDING METHOD AND IMAGE RECORDING APPARATUS USING THE SAME

(75) Inventors: Tatsuhiko Miyoshi, Amagasaki (JP); Eiji Yamakawa, Sanda (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/953,981

(22) Filed: Sep. 17, 2001

(65) Prior Publication Data

US 2002/0041322 A1 Apr. 11, 2002

(30) Foreign Application Priority Data

Sep. 29, 2000 (JP) ..... 2000-299448

(51) Int. Cl.[7] ..... B41J 2/36; B41M 5/36
(52) U.S. Cl. ..... 347/171
(58) Field of Search ..... 347/171, 193; 503/201; 430/19, 20, 42; 349/32; 369/275.2; 400/120.1, 120.09, 120.13

(56) References Cited

U.S. PATENT DOCUMENTS 6,197,460 B1 3/2001 Tamaoki et al. ..... 430/20

FOREIGN PATENT DOCUMENTS

JP 11-024027 1/1999
JP 11-277913 10/1999

OTHER PUBLICATIONS

U.S. patent application Ser. No. 09/276,354 Yamakawa et al. filed Mar. 25, 1999, pending.
Nobuyuki Tamaoki, Alexander V. Parfenov, Atsushi Masaki and Hiro Matsuda, "*Rewritable Full–Color Recording on a Thin Solid Film of a Cholesteric Low–Molecular–Weight Compound*" *Advanced Materials*, vol. 9, No. 14, pp. 1102–1104 (1997)

*Primary Examiner*—Huan Tran
(74) *Attorney, Agent, or Firm*—Sidley Austin Brown & Wood LLP

(57) ABSTRACT

Disclosed herewith is an image recording apparatus for recording an image on a reversible thermal recording medium that has a thermal recording layer containing a cholesteric liquid crystal compound having medium molecular weight. The image recording apparatus comprises: a recording head for heating the reversible thermal recording medium; a sensor for detecting a kind of the reversible recording medium; and a speed control unit which is capable of changing, based on the detected kind of the reversible image recording medium, a relative print feeding speed of the recording head and the reversible thermal recording medium.

14 Claims, 6 Drawing Sheets

IMAGE RECORDING METHOD AND IMAGE RECORDING APPARATUS USING THE SAME

BACKGROUND OF THE INVENTION

1. Field of the Invention

The present invention relates to an image recording apparatus and an image recording method, and more particularly, to an image recording apparatus and an image recording method for writing an image onto a recording medium having a reversible thermal recording layer.

2. Description of the Related Art

As a material effective for recording media capable of multicolor recording and erasure, a cholesteric liquid crystal compound with a molecular weight of approximately 1000 has previously been known (see Japanese Laid-open Patent Application No. H11-24027). This type of cholesteric liquid crystal compound selectively reflects only a specific wavelength in a liquid crystal phase temperature region, and the selectively reflected wavelength varies according to the temperature. The condition where the cholesteric liquid crystal compound selectively reflects the specific wavelength can be fixed by rapidly cooling the compound from the liquid crystal phase temperature region to a solid phase temperature region. This is a characteristic that makes the compound effective as a material for reversible thermal recording media.

For this type of reversible thermal recording media, the temperature of heating from the recording head is controlled to thereby obtain desired colors. Although various types have been provided as image recording apparatuses having a recording head for heating, an apparatus is absent in which the heating time can be controlled and that is suitable for image recording onto reversible thermal recording media containing the cholesteric liquid crystal compound.

SUMMARY OF THE INVENTION

Accordingly, an object of the present invention is to provide an image recording apparatus and an image recording method capable of recording an image efficiently in desired colors onto a reversible thermal recording medium having a thermal recording layer containing the cholesteric liquid crystal compound.

According to an experiment performed by the present inventors, it was found that not only the heating time varies among the developed colors but also the most suitable heating time varies according to the kind of the liquid crystal material, the thickness of the recording layer and the like even when the same color is printed.

In light of the above-mentioned finding, the present invention was devised. Specifically, an image recording apparatus reflecting one aspect of the present invention comprises: a recording head for heating a reversible thermal recording medium that has a thermal recording layer containing a cholesteric liquid crystal compound to a predetermined temperature; and a speed control unit which is capable of changing a relative print feeding speed of the recording head and the reversible thermal recording medium.

In the image recording apparatus having the above-described structure, the quantity of heat applied from the recording head can be represented by the product of the consumed power and the heating time. The heating time is controlled by the relative print feeding speed of the recording head and the recording medium. Therefore, by changing the print feeding speed according to the kind of the reversible thermal recording medium (the kind of the liquid crystal, the thickness of the liquid crystal layer, the material and the thickness of the protecting layer and the base material, etc.), color development and the like, an image can be recorded in a desired color development condition with high quality.

After stopped at a position of an intended print pixel and heated to a predetermined temperature for printing, the recording medium and the recording head are stopped for a predetermined time to maintain heating at that temperature. In the present invention, the quotient when the predetermined time is divided by the distance of movement will be called a print feeding speed.

The image recording apparatus according to the present invention may have a sensor that detects the kind of the reversible thermal recording medium. By providing such sensor, recording can be performed reliably at a recording speed most suitable for the recording medium. When the sensor is one that detects the thickness of the recording medium and/or a mark previously provided on the recording medium, the kind of the recording medium can be grasped easily and reliably. An operation member for manually changing the print feeding speed may be provided.

Further, in the image recording apparatus according to the present invention, a detector that detects the condition of colors printed by the recording head may be provided so that the result of the detection by the detector is fed back to the speed control unit. By providing the detector and feeding back the result of the detection, more precise color development can be performed.

Further, a temperature control unit that makes the heat generation temperature of the recording head variable may be provided. By making the heat generation temperature variable, more precise color development can be performed.

According to another aspect of the present invention, a first image recording method comprises the steps of: determining a kind of a reversible recording medium that has a thermal recording layer containing a cholesteric liquid crystal compound; setting a recording speed according to the determined kind of the reversible thermal recording medium; and recording an image onto the reversible thermal recording medium by heating the reversible thermal recording medium to a predetermined temperature with the set recording speed. By setting or changing the recording speed according to the kind of the recording medium, an image can be recorded in a desired color development condition with high quality.

A second image recording method reflecting still further aspect of the present invention comprises:

determining a color development condition of a reversible recording medium that has a thermal recording layer containing a cholesteric liquid crystal compound; setting a recording speed according to the determined color development condition the reversible thermal recording medium; and recording an image onto the reversible thermal recording medium by heating the reversible thermal recording medium to a predetermined temperature with the set recording speed. By setting the recording speed according to the color development condition of the recording medium, an image can be recorded in a desired color development condition with high quality.

In addition to the recording speed, the heat generation temperature of the recording head may also be changed. By doing this, finer color development control can be performed.

BRIEF DESCRIPTION OF DRAWINGS

These and other objects, advantages and features of the invention will become apparent from the following description thereof taken in conjunction with the accompanying drawings in which.

PREFERRED EMBODIMENTS OF THE PRESENT INVENTION

Hereinafter, embodiments of an image recording apparatus and an image recording method according to the present invention will be described with reference to the accompanying drawings.

First Embodiment

FIGS. 1 to 4

Figure 1:
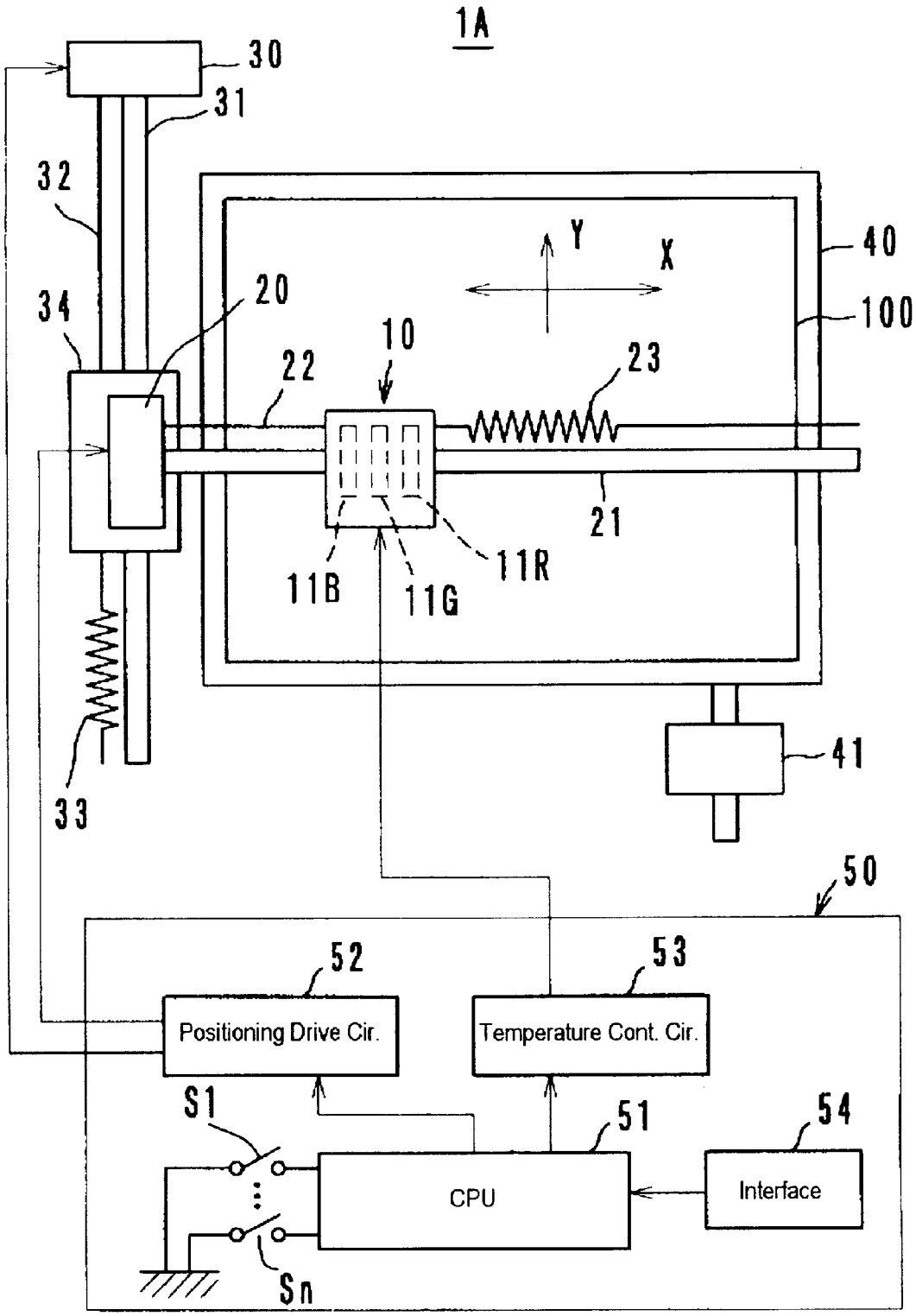
FIG. 1 is a schematic block diagram showing an image recording apparatus according to a first embodiment of the present invention.

An image recording apparatus 1A according to a first embodiment of the present invention comprises as shown in FIG. 1: a thermal head 10; a pulse motor 20 that moves the thermal head 10 in the direction of the x-axis; a pulse motor 30 that moves the thermal head 10 in the direction of the y-axis; a holder 40 for holding a reversible thermal recording medium 100; and a control portion 50.

On the surface of the holder 40, a multiplicity of non-illustrated air suction holes are formed, and by sucking in air by a pump 41 coupled to the air suction holes to maintain the pressure inside the air suction holes negative, the recording medium 100 is held on the surface of the holder 40 while adhering closely thereto.

The thermal head 10 is mounted on a rail 21 so as to be movable in the direction of the x-axis. A wire 22 and a spring 23 for pulling are attached to the left and the right sides of the thermal head 10 so as to be immovable. The wire 22 is coupled to the motor 20. That is, the thermal head 10 is moved leftward in FIG. 1 at a predetermined speed by the motor 20 winding the wire 22. When the load by the motor 20 is released, the thermal head 10 is returned rightward by the spring 23.

The rail 21 and the motor 20 are mounted on another rail 31 through a slider 34 SO as to be movable in the direction of the y-axis. A wire 32 and a spring 33 for pulling are attached to the top and the bottom so as to be immovable. The wire 32 is coupled to the motor 30. That is, the thermal head 10 is moved upward in FIG. 1 at a predetermined speed by the motor 30 winding the wire 32. When the load by the motor 30 is released, the thermal head 10 is returned downward by the spring 33.

The control portion 50 has as the main element a central processing unit (CPU) 51 incorporating a control program, and is provided with a positioning drive circuit 52 that moves the thermal head 10 in the directions of the x- and y-axes at a predetermined speed and a temperature control circuit 53 that adjusts the temperatures of heads 11R, 11G and 11B for red, green and blue mounted on the thermal head 10. The CPU 51 is connected to an external apparatus such as a personal computer through an interface 54, and data of an image to be drawn and the like is transferred to the CPU 51 therefrom.

The control portion 50 is also provided with switches S1 to Sn for determining the kind of the recording medium 100. The switches S1 to Sn are turned on manually by the operator or turned on based on a signal from the external apparatus.

Figure 2:
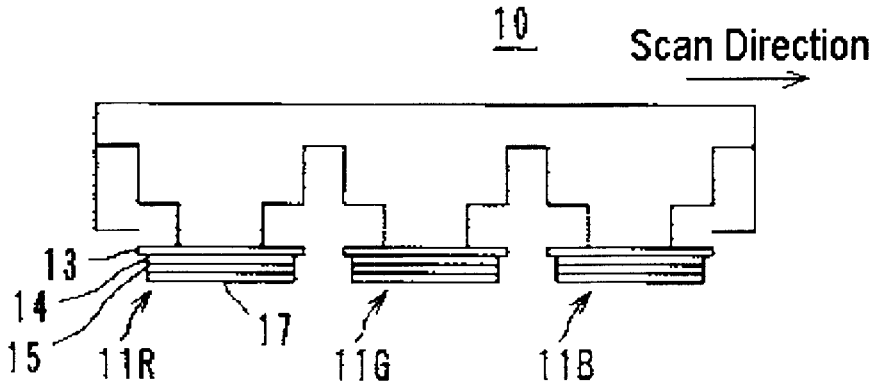
FIGS. 2 to 4 are a front view, a side view and a bottom view showing a thermal head, respectively.

On the thermal head 10, as shown in FIG. 2, the head 11R for red for low-temperature heating (for developing red), the head 11G for green for mid-temperature heating (for developing green) and the head 11B for blue for high-temperature heating (for developing blue) are juxtaposed. On each of the heads 11R, 11G and 11B for red, green and blue, a plurality of heating elements are arranged in a line in a direction (y-axis) perpendicular to a scanning direction (x-axis).

While eight heating elements are arranged in a line in the first embodiment, the number of heating elements may be changed as required. While the thermal head 10 comprises the three heads 11R, 11G and 11B for red, green and blue in the first embodiment, the thermal head 10 may be provided with a head for higher-temperature heating than the head 11B for high-temperature heating (that is, a head for developing transparency) and a head capable of lower-temperature heating than the head 11R for low-temperature head 11R. Further, a plurality of colors may be developed by one head 11.

The magnitude of the current applied to the heating elements disposed on the heads 11 varies with time. The current is controlled by the temperature control circuit 53 in response to an instruction from the CPU 51.

For the reversible thermal recording medium 100 containing a cholesteric liquid crystal compound described below, the color tone is controlled by a delicate temperature adjustment. The heating time to obtain the same color tone varies according to: the characteristic of the liquid crystal compound used; and the thickness of the recording layer or the like.

Figure 3:
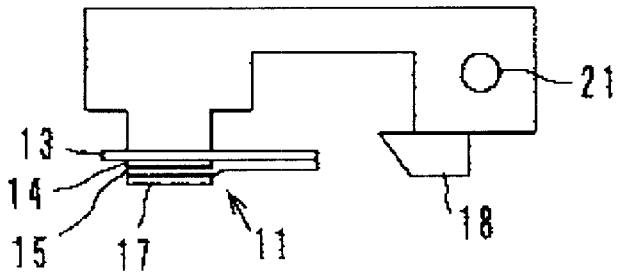
Figure 4:
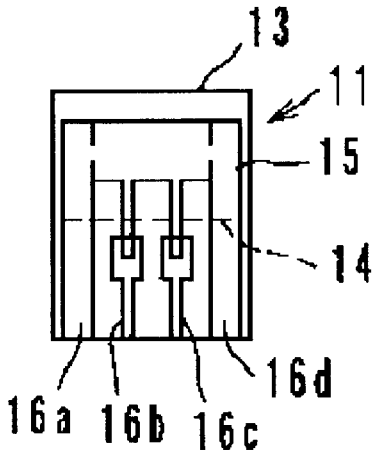

The heating elements are heated to a predetermined temperature by being supplied with a current corresponding to the kind of the recording medium 100 set on the holder 40 and the print (color tone) signal by the temperature control circuit 53. That is, in each of the heating elements, as shown in FIGS. 3 and 4, a glaze layer 14 made of quartz glass or the like and a heating layer 15 made of a tantalum compound or the like are formed on a substrate 13 made of alumina or the like. The temperature control circuit 53 applies a voltage commensurate with the current to be applied to the heating elements between electrodes 16a and 16d disposed on both sides of the heating layer 15, thereby causing the heating elements to generate heat. Electrodes 16*b* and 16*c* disposed inside monitor the potential difference between the electrodes 16*b* and 16*c*. As these electrodes, for example, films formed by laminating chromium and aluminum may be used. On the heating layer 15, a protecting layer 17 made of $SiO_2$ or the like is formed.

Further, on the thermal head 10, a color tone detector 18 comprising a white light source and a spectrum sensor is disposed in correspondence with each of the heads 11R, 11G and 11B for red, green and blue. By outputting the result of the detection to the CPU 51 to feed it back to the temperature control, the print feeding speed is finely adjusted so that the color tone is ensured.

In order that a desired color is obtained, the temperature control circuit 53 is capable of adjusting the current applied to the heating elements when determining that the heads 11 are overheated with reference to the information on the potential difference between the electrodes 16*b* and 16*c*.

When no color change is detected although heating by the thermal head 10 is repeated, since there is a possibility that the recording medium 100 is set on the holder 40 with a surface other than the recording surface toward the thermal head 10, a buzzer B is sounded as a warning.

When the pixels are printed while the heating elements are being caused to generate heat, a so-called image trailing phenomenon sometimes occurs due to a movement of the heating elements after printing. To prevent the trailing phenomenon, it is desirable to dispose a forced cooler on the thermal head 10. In the first embodiment, a forced cooler (not shown) is attached to a heat radiating surface opposite to the heating surface with the glaze layer 14 in between.

In the image recording apparatus 1A having the above-described structure, the pulse motor 30 is driven to move the thermal head 10 in the direction of the y-axis one pitch at a time while driving the pulse motor 20 to cause the thermal head 10 to scan in the direction of the x-axis, thereby performing printing onto the recording medium 100 pixel-by-pixel.

The amount of applied heat necessary for printing one pixel (for developing a predetermined color) is controlled by the heating temperatures and the heating times of the heads 11R, 11G and 11B for red, green and blue. The heating (printing) time is a time during which the thermal head 10 is intermittently stopped for heating at each pixel. For a certain recording medium, the heating time is, for example, 0.2 second for red, 0.1 second for green and 0.05 second for blue. For a different recording medium, a different heating (printing) time is required for each color. Therefore, the CPU 51 controls the print feeding speed based on whether the switches S1 to Sn for determining the kind of the recording medium are on or off. Specifically, for a recording medium requiring a long recording time, the CPU 51 decreases the recording speed of the thermal head 10, and for a recording medium requiring a short recording time, the CPU 51 increases the recording speed of the thermal head 10. In addition to changing the recording speed, the CPU 51 adjusts the time of energization of the thermal head 10, thereby performing finer color development control. The speed at which the thermal head 10 moves stepwisely every printing of each pixel is constant.

The scanning direction of the thermal head 10 may be the direction of the y-axis instead of the direction of the x-axis. Alternatively, a structure may be used such that the thermal head 10 is capable of scanning only in one direction and the holder 40 (the recording medium 100) is movable in a direction perpendicular thereto. The mechanism for moving the thermal head 10 may be a self-advancing type integrally incorporating the pulse motors and the head 10.

A first example of printing procedure is to initialize the recording medium to a specific background color and write an image in a different color. For example, an image can be drawn in green on a blue background, or can be drawn in blue on a red background. Initialization and writing in a different color on each pixel may be performed in succession while causing the thermal head 10 to scan. In lieu of this procedure, the following procedure may be employed. That is, after scanning a part of the medium to initialize it to a specific background color, scanning of this initialized part is carried out again to write the specific color thereto. In either case, the print feeding speed is changed according to the kind of the recording medium and the developed color.

A second example of printing procedure is to write an image in full color directly onto the recording medium. In this case, the thermal head 10 is intermittently stopped every pixel for a necessary heating time for each of blue, green and red, thereby performing printing.

The thermal head 10 may be provided with heating elements used specifically for erasure or initialization. In a case the entire surface or a specific part of the recording medium is initialized before image drawing, it is inefficient that the heating elements of the thermal head 10 for image recording perform initialization and image drawing in succession. Provision of heating elements for erasure enables initialization and image drawing to be performed efficiently by one scanning.

The print feeding speed itself may be controlled by use of the color tone detector 18. That is, the following may be performed: The thermal head 10 is stopped for one pixel while generating heat, and when the color tone detector 18 detects that a predetermined color tone is developed, the thermal head 10 is moved to the next pixel position.

In the first embodiment, the thermal head is fixed in a position in the proximity of or in contact with the recording medium. However, from the viewpoint of preventing an adverse effect due to overheating of the thermal head, an actuator may be connected to the head for each color so that contact and separation between the thermal head and the recording medium are controlled by extending or contracting the actuator. For example, each actuator is contracted while the head to which the actuator is connected is moving from one pixel to another, or each actuator is contracted when the head finishes heating.

Further, in the first embodiment, since the thermal head can be moved in the directions of the x- and the y-axes, that is, to an arbitrary two-dimensional position, the image recording apparatus 1A can be used like a plotter printer.

Second Embodiment

FIG. 5

Figure 5:
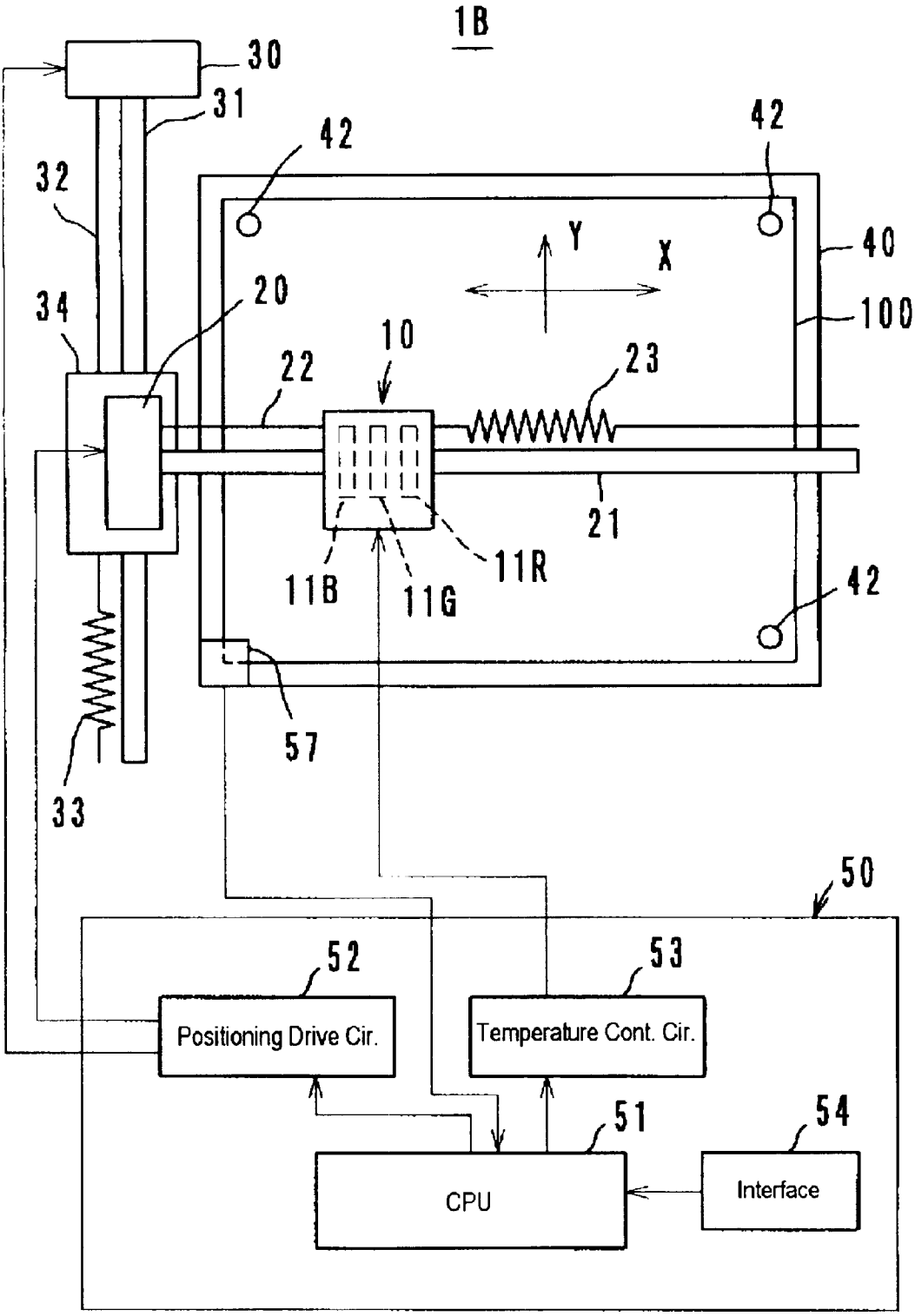
FIG. 5 is a schematic block diagram showing an image recording apparatus according to a second embodiment of the present invention.

An image recording apparatus 1B according to a second embodiment of the present invention is, as shown in FIG. 5, basically same as the image recording apparatus 1A shown as the first embodiment. Therefore, like members are designated by like reference numbers, and repeated descriptions thereof are omitted.

The image recording apparatus 1B is different from the image recording apparatus 1A in that a ferromagnetic material is provided in corners of the holder 40 and the recording medium 100 is held by use of magnets 42 and that a displacement switch 57 for determining the kind of the recording medium 100 is attached to the holder 40. The displacement switch 57 automatically determines the thickness of the recording medium 100 attached to the holder 40, and outputs the determined thickness to the CPU 51. The CPU 51 identifies the recording medium from data prestored in an internal memory based on the information on the thickness of the recording medium 100, and decides the speed of printing by the thermal head 10.

The operation of recording onto the recording medium 100 by the image recording apparatus 1B, particularly, the control of the print feeding speed of the thermal head 10 is similar to that of the image recording apparatus 1A.

As another structure for determining the kind of the recording medium, a sensor may be used that mechanically, optically, magnetically or electrically reads a mark (a print mark, a hole, a notch, projections and depressions, etc.) previously provided in association with the kind (the material, the thickness, the size, etc.) of the recording medium. In any case, the kind of the recording medium can be grasped easily and reliably.

Third Embodiment

FIG. 6

Figure 6:
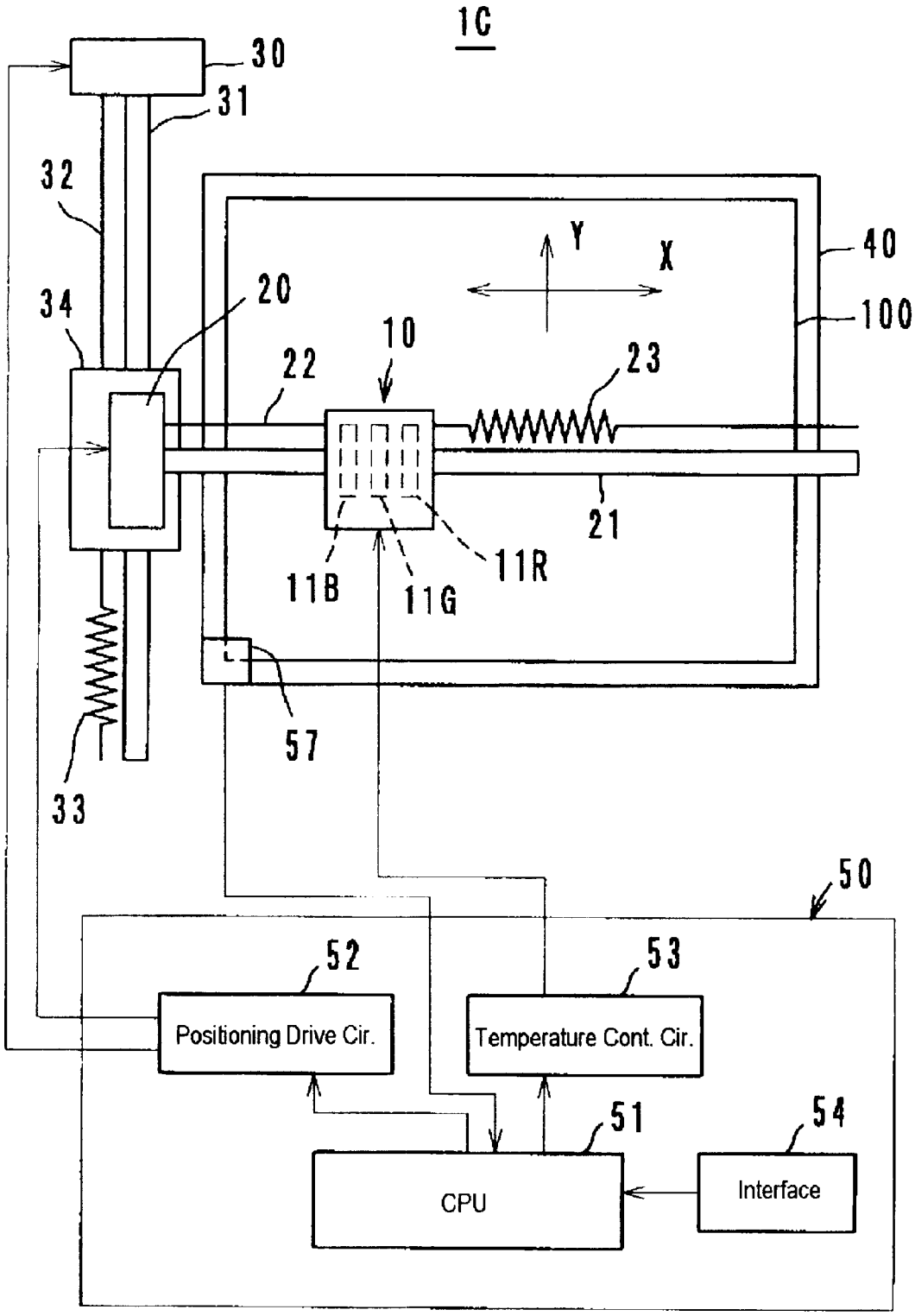
FIG. 6 is a schematic block diagram showing an image recording apparatus according to a third embodiment of the present invention.

An image recording apparatus 1C according to a third embodiment of the present invention is, as shown in FIG. 6, basically same as the image recording apparatus 1B shown as the second embodiment. Therefore, like members are designated by like reference numbers, and repeated descriptions thereof are omitted.

The image recording apparatus 1C is different from the image recording apparatus 1B in that an electrostatic adherer (not shown) such as a coil is provided on the holder 40 and the recording medium 100 is held while electrostatically adhering to the holder 40.

The operation of recording onto the recording medium 100 by the image recording apparatus 1C, particularly, the control of the print feeding speed of the thermal head 10 is similar to those of the image recording apparatuses 1A and 1B.

Fourth Embodiment

Figure 7:
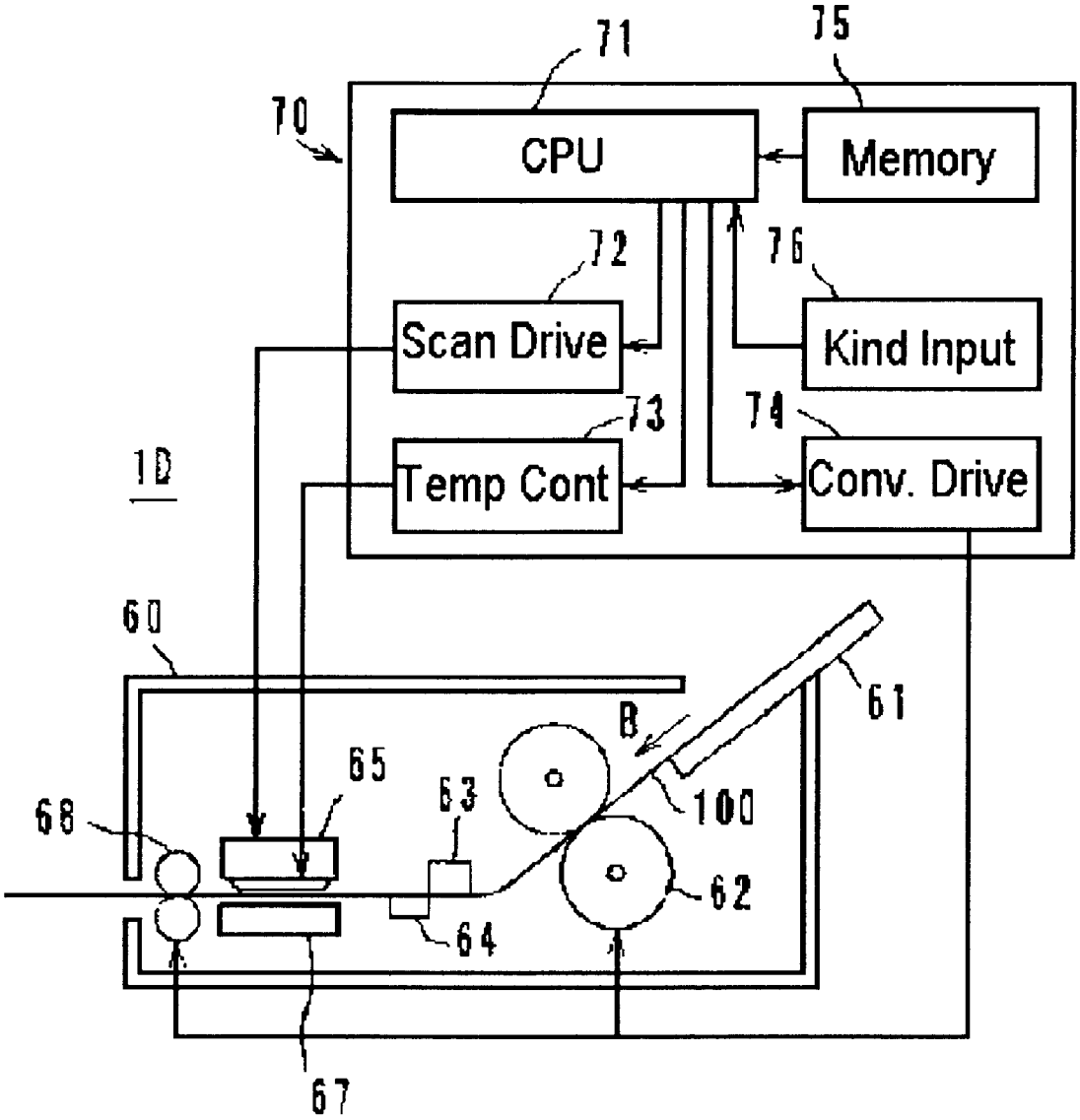
FIG. 7 is a schematic block diagram showing an image recording apparatus according to a fourth embodiment of the present invention.
Figure 8:
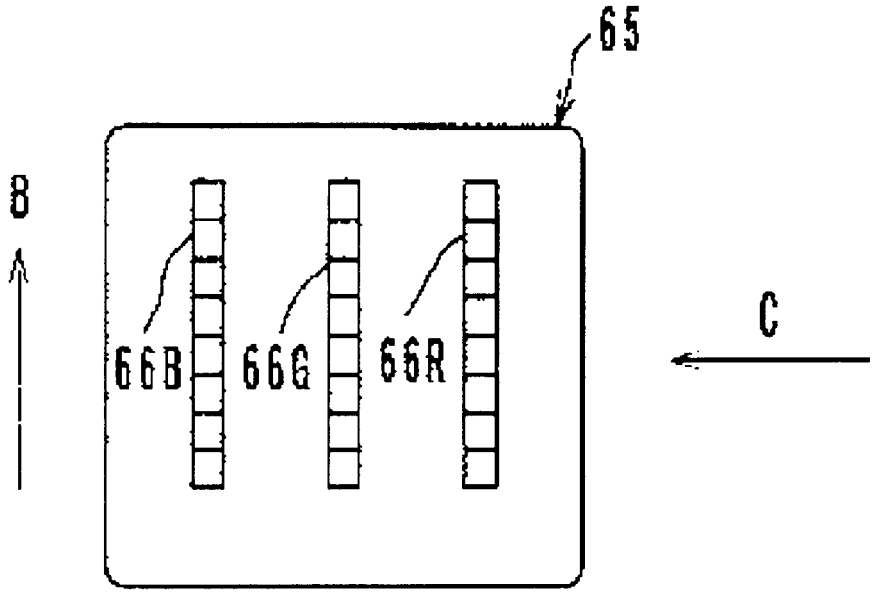
FIG. 8 is a bottom view showing a thermal head.

FIGS. 7 and 8

In an image recording apparatus 1D according to a fourth embodiment of the present invention, as shown in FIG. 7, the following are set in a housing 60 in a direction B in which the recording medium 100 is conveyed: a tray 61; a pair of conveyance rollers 62; an erasing head 63; a cooling bar 64; a thermal head 65; a platen 67; and a pair of conveyance rollers 68.

A control portion 70 has as the main element a CPU 71 incorporating a control program, and is provided with: a scanning drive circuit 72 that causes the thermal head 65 to scan in a direction C (refer FIG. 8) perpendicular to the conveyance direction B of the recording medium 100; a temperature control circuit 73 that adjusts the temperatures of heating elements 66B, 66G and 66R mounted on the thermal head 65; and a conveyance drive circuit 74 that intermittently drives the conveyance rollers 62 and 68 to convey the recording medium 100 in the direction of the arrow B.

The control portion 70 is provided with an image data memory 75 and a kind input circuit 76. To the kind input circuit 76, the kind of the recording medium 100 set on the tray 61 is input by the operator or by an automatic detector attached to the tray 61.

The thermal head 65 has a similar structure to the thermal head 10, and comprises the heating elements 66B, 66G and 66R for developing the three primary colors.

The recording medium 100 is heated to a predetermined temperature while being conveyed from the tray 61 to the erasing head 63 by the conveyance rollers 62, and then, is rapidly cooled by the cooling bar 64. In this process, the image having already been written on the recording medium 100 is erased. Then, the recording medium 100 is sent to the gap between the thermal head 65 and the platen 67, and an image is printed here.

Image printing is performed by intermittently conveying the recording medium 100 and causing the thermal head 65 to scan in the direction of the arrow C while the recording medium 100 is stopped. Scanning is intermittently performed every pixel. The stop time per pixel corresponds to the print feeding speed, and the print feeding speed is controlled so as to vary according to the kind of the recording medium 100 and which of blue, green and red is developed. That is, the control of printing is similar to that of full-color image drawing described in the first embodiment. After printing, the recording medium 100 is rapidly self-cooled to fix the written image, and is ejected out of the apparatus through the conveyance rollers 68.

Structure of Recording Medium and Liquid Crystal Material

The structure and the material of the reversible thermal recording medium will be described.

Figure 9:
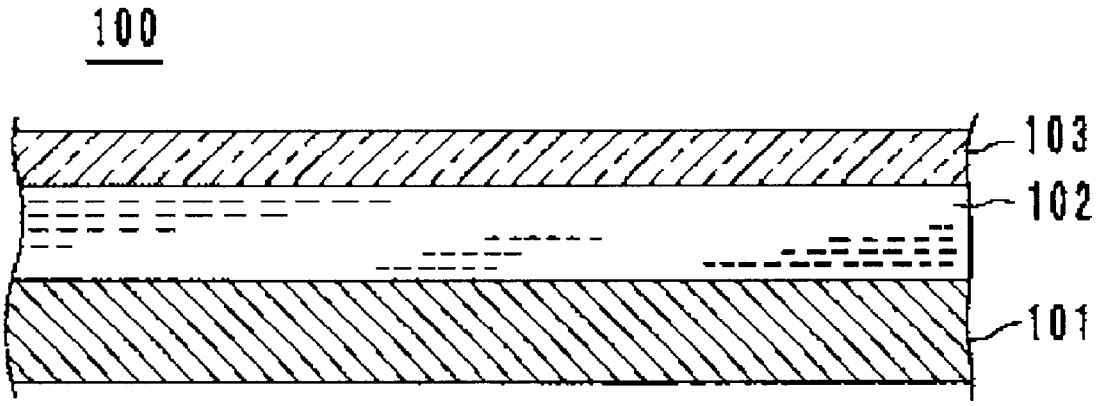
FIG. 9 is a cross-sectional view showing a reversible thermal recording medium.

FIG. 9 shows the cross section of the recording medium 100. On a sheet material 101, a thermal recording layer 102 containing a cholesteric liquid crystal compound is formed, and a protecting film 103 is laid thereon. The thermal recording layer 102 is applied to at least one surface of the sheet material 101. The recording layer may be provided on both surfaces of the sheet material 101.

As the sheet material 101, it is desirable to use a high molecular weight sheet. As the material for the high molecular weight sheet, polyethylene terephthalate, polycarbonate, polyether sulfon, polyphenyl sulfide or the like can be used.

The protecting film 103 must be transparent to transmit light, and like the sheet material 101, a high molecular weight material can be used therefor. Instead of providing a film, a protecting layer may be formed by applying a high molecular weight solution to the surface of the recording layer 102, or by applying an organic resin monomer to the surface of the recording layer 102, cross-linking the monomer and depositing an inorganic material.

On the sheet material 101, a light absorbing layer for absorbing visible light may be provided. For example, a resin or a coating containing carbon black, a coloring agent or the like may be applied to the obverse or the reverse surface of the sheet material 101. The sheet material 101 itself may have the capability of absorbing visible light. It is desirable that the surface of the sheet material 101 that is in contact with the recording layer 102 be smooth, and an intermediate layer having a smooth surface may be provided. The intermediate layer may have the capability of absorbing visible light.

Further, it is desirable that spacers having a predetermined diameter be mixed in the recording layer 102 in order that the thickness of the recording layer 102 be uniform. For a similar purpose, resin structures may be formed in the recording layer 102 at regular intervals or at random intervals.

As the liquid crystal forming the recording layer 102, a low or a high molecular weight cholesteric liquid crystal compound is used. Because of its excellent memory capability and high writing speed, a middle molecular weight cholesteric liquid crystal compound with a molecular weight of approximately 500 to 2000 is suitably used. Concrete examples of the suitably used cholesteric liquid crystal compound will be shown below.

(A)

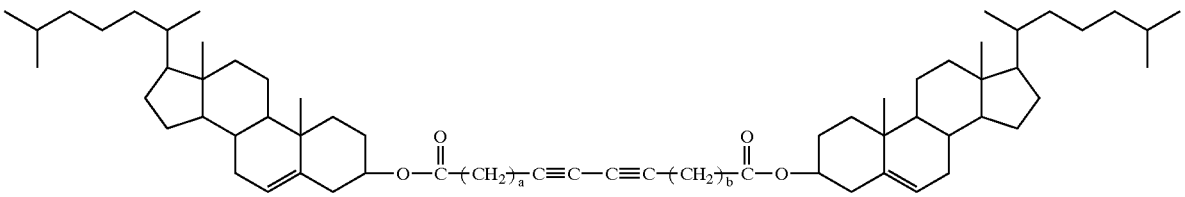

a and b represent a combination of integral numbers where a + b is not l ower than 5 and not higher than 20.

(B)

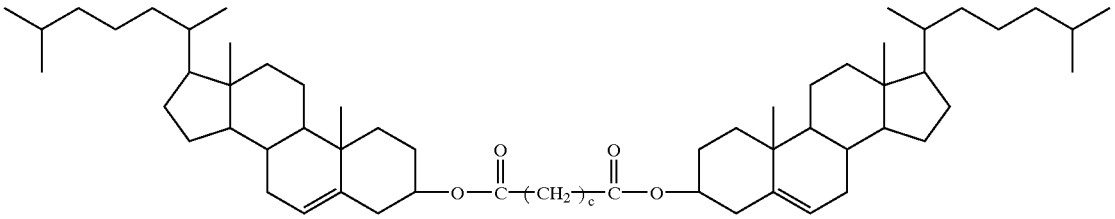

c represents an integral number not lower than 5 and not higher than 20.

(C)

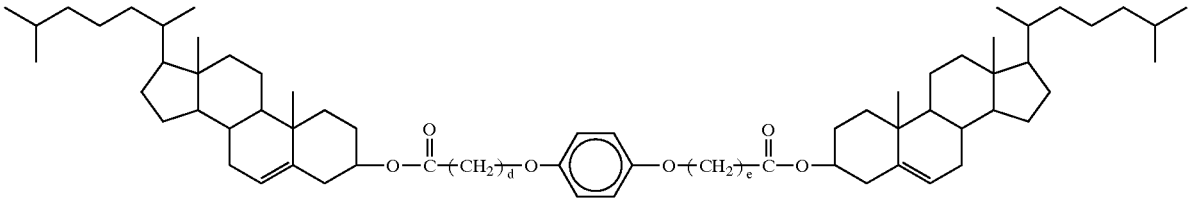

d and e represent a combination of integral numbers where d + e is not l ower than 5 and not higher than 20.

(D)

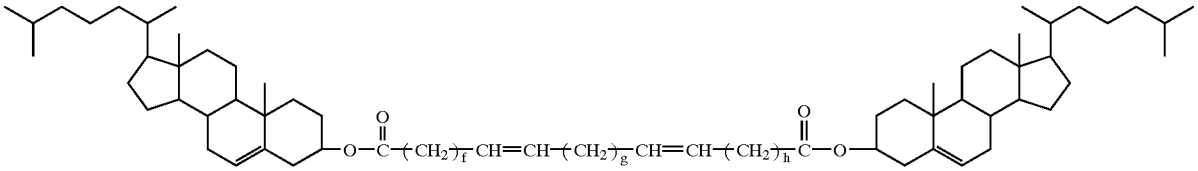

f, g and h represent a combination of integral numbers where f + g + h i s not lower than 5 and not higher than 20.

(E)

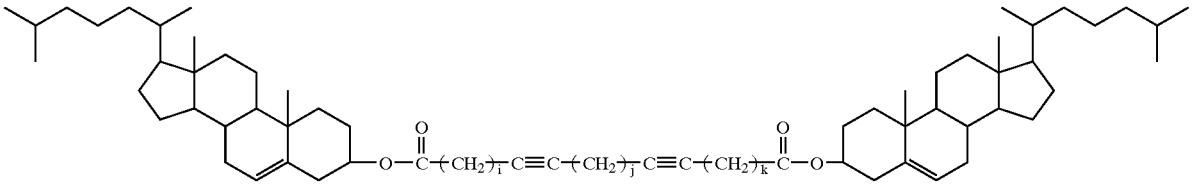

i, j and k represent a combination of integral numbers where i + j + k i s not lower than 5 and not higher than 20. Here, a case where j = 0 is ex cluded.

(F)

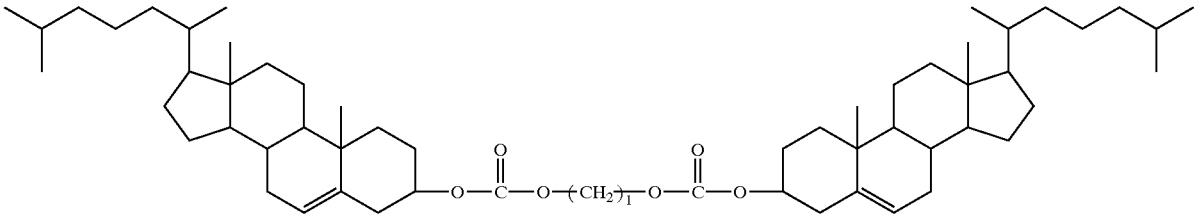

l represents an integral number not lower than 5 and not higher than 20.

-continued (G)

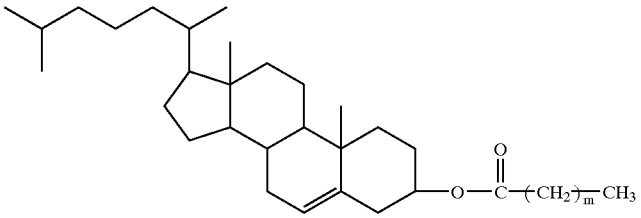

m represents an integral number not lower than 5 and not higher than 20.

These compounds may be, for example, combinations of compounds having the same basic skeleton and different alkyl chain lengths, or combinations of compounds having different basic skeletons. Three or more kinds of compounds can be mixed when some kinds of compounds are used. In addition to (A) to (G) shown as examples, various kinds of middle molecular weight cholesteric liquid crystal compounds can be used.

Moreover, conventional nematic liquid crystal may be added. Combination of a plurality of kinds of middle molecular weight cholesteric liquid crystal compounds and addition of nematic liquid crystal are advantageous in increasing the reproducibility of the displayed colors and performing image writing in a short time.

It is desirable that at least one kind of the middle molecular cholesteric liquid crystal compounds have a molecular weight of 1000 to 1500. This is because when the molecular weight is not more than 1000, the memory capability of color development is low and when the molecular weight is more than 1500, the response to writing deteriorates and the temperature of transition to the cholesteric phase is too high.

In a recording layer that the present inventors made on an experimental basis by use of a mixture of equal quantities of a compound where a=b=8 in the chemical formula (A) and a compound where c=11 in the chemical formula (B), when heated until becoming an isotropic phase, adjusted to a given temperature in a range of 55 to 120° C. and rapidly cooled from the temperature, liquid crystal exhibited a cholesteric phase with the helical axes oriented in a direction vertical to the sheet material, and reflected light of a specific wavelength corresponding to the temperature. When the temperature was approximately 60° C., the liquid crystal became red. When the temperature was approximately 75° C., the liquid crystal became green. When the temperature was approximately 100° C., the liquid crystal became blue. By rapidly cooling from these temperatures, the liquid crystal solidified in the reflecting condition. Here, as the rapid cooling, if the environment is at ordinary temperatures, self-cooling where the liquid crystal is set aside after heated is sufficient.

When rapidly cooled after heated to approximately 120° C. or higher, the liquid crystal became transparent. That is, when rapidly cooled after heated to approximately 120° C. or higher, the recording layer becomes transparent. In this case, when a light absorbing layer is provided on the sheet material, black is displayed since visible light is absorbed.

With respect to formation of an image on the recording layer 102, although (1) the liquid crystal may be heated directly to a necessary temperature without heated until becoming an isotropic phase, the range of reproducible colors is generally wider when (2) the liquid crystal is heated until becoming an isotropic phase, then cooled to a necessary temperature, and then rapidly cooled from the temperature. Therefore, when an image abundant in colors is formed, it is desirable to perform writing by the method (2) or to record (reset) by the method (2) colors that cannot be reproduced by recording by heating the liquid crystal directly to a desired temperature and then, perform recording by the method (1).

The recording layer can be reset to a predetermined color. In this case, after heated to a temperature of transition to an isotropic phase or higher, the liquid crystal is controlled so as to maintain, from this temperature, a temperature at which the liquid crystal performs a desired selective reflection. For example, in a case where heating is performed by a heating roller, after passing the heating roller, the recording medium is conveyed by a predetermined distance along the conveyance path, and is set aside until cooled to a temperature at which the liquid crystal exhibits a desired selective reflection color. When the desired reflection color is obtained, the recording medium is rapidly cooled by passing a cooling roller, so that the recording medium is fixed with the reflection color at that time maintained.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein. For example, the structure and the material of the reversible thermal recording medium are arbitrary. Moreover, the recording medium holding mechanism, and the structure and the driving method of the recording head are arbitrary.

What is claimed is:

1. An image recording apparatus comprising:

a recording head for heating a reversible thermal recording medium that has a thermal recording layer containing a cholesteric liquid crystal compound to a predetermined temperature; and a speed control unit which is capable of changing a relative print feeding speed of the recording head and the reversible thermal recording medium.

2. An image recording apparatus as claimed in claim 1, further comprising:

a sensor for detecting a kind of the reversible thermal recording medium, wherein the speed control unit changes the relative feeding speed in accordance with the kind of the reversible thermal recording medium detected by the sensor.

3. An image recording apparatus as claimed in claim 2, wherein said sensor detects a thickness of the recording medium.

4. An image recording apparatus as claimed in claim 2, wherein said sensor detects a mark previously provided on the recording medium.

5. An image recording apparatus as claimed in claim 1, further comprising:

an operation member for being manually operated by an operator, wherein said speed control unit changes the relative speed in accordance with a condition of said operation member.

6. An image recording apparatus as claimed in claim 1, further comprising:

a detector for detecting a condition of colors having been printed by the recording head, wherein said speed control unit changes the relative speed in accordance with the condition detected by said detector.

7. An image recording apparatus as claimed in claim 1, further comprising:

a temperature control unit for adjusting a heat generation temperature of the recording head.

8. An image recording method comprising the steps of:

(a) determining a kind of a reversible recording medium that has a thermal recording layer containing a cholesteric liquid crystal compound;

(b) setting a recording speed in accordance with the determined kind of the reversible thermal recording medium; and (c) recording an image onto the reversible thermal recording medium by heating the reversible thermal recording medium to a predetermined temperature with the set recording speed.

9. An image recording method as claimed in claim 8, wherein, in the step (a), the kind of the reversible recording medium is determined based on a thickness of the reversible recording medium.

10. An image recording method as claimed in claim 8, wherein, in the step (a), the kind of the reversible recording medium is determined based on a mark previously provided on the recording medium.

11. An image recording method as claimed in claim 8, wherein, in the step (a), the kind of the reversible recording medium is determined based on a condition of an operation member that is capable of being manually operated by an operator.

12. An image recording method as claimed in claim 8, the step (a) comprising the steps of.

(a1) recording a sample image on the reversible recording medium by heating the reversible thermal recording medium; and (a2) detecting a color development condition of the sample image recorded on the reversible recording medium.

13. An image recording method comprising the steps of:

(a) determining a color development condition of a reversible recording medium that has a thermal recording layer containing a cholesteric liquid crystal compound;

(b) setting a recording speed according to the determined color development condition of the reversible thermal recording medium; and (c) recording an image onto the reversible thermal recording medium by heating the reversible thermal recording medium to a predetermined temperature with the set recording speed.

14. An image recording method as claimed in claim 13, wherein the step (a) comprising the steps of:

(a1) recording a sample image on the reversible recording medium by heating the reversible thermal recording medium; and (a2) detecting a color development condition of the sample image recorded on the reversible recording medium.

* * * * *